US006135811A

United States Patent [19]

Daoud

[11] Patent Number: 6,135,811

[45] Date of Patent: Oct. 24, 2000

[54] RJ11 CUSTOMER BRIDGE ASSEMBLY WITH INTEGRATED GEL COVER

[75] Inventor: Bassel H. Daoud, Parsippany, N.J.

[73] Assignee: Lucent Technologies Inc., Murray Hill, N.J.

[21] Appl. No.: 09/388,104

[22] Filed: Sep. 1, 1999

[51] Int. Cl.[7] ..... H01R 13/52

[52] U.S. Cl. ..... 439/519; 439/521; 439/676

[58] Field of Search ..... 439/519, 521, 439/142, 417, 676, 555, 144; 379/399, 451

[56] References Cited

U.S. PATENT DOCUMENTS 4,979,209 12/1990 Collins et al. ..... 439/345
5,260,994 11/1993 Suffi ..... 439/676
5,562,491 10/1996 Shimirak et al. ..... 439/521
5,671,273 9/1997 Lanquist ..... 439/521
5,888,079 3/1999 Norden ..... 439/676

*Primary Examiner*—Hien Vu
*Attorney, Agent, or Firm*—David L. Davis

[57] ABSTRACT

An RJ11 customer bridge assembly having a cover member for selectively closing a plug-receiving cavity and preventing unauthorized removal of the assembly from a building entrance protector box by blocking movement of a releasable latch member. Contaminated protective gel in the cavity is easily replaced by opening the cover member and blowing out the contaminated gel.

4 Claims, 2 Drawing Sheets

RJ11 CUSTOMER BRIDGE ASSEMBLY WITH INTEGRATED GEL COVER

BACKGROUND OF THE INVENTION

This invention relates to RJ11 customer bridge assemblies used in outdoor applications and, more particularly, to an improved bridge assembly of this type which has an integrated cover for containing protective gel within the RJ11 jack.

RJ11 customer bridge assemblies are typically installed in a building entrance protector box to provide connections between outside plant telephone wires and telephone wires extending within a building to the customers' premises. Each such bridge assembly includes a pair of terminals to which a pair of inside telephone wires are connected and an RJ11 plug and jack for connecting a pair of outside telephone wires to the terminals. To minimize the corrosive effects of the outdoor environment, the RJ11 jack is usually filled with a gel, which is displaced by the plug when the plug is installed in the jack. Up to now, such jacks have been designed with a solid bottom in order to trap and retain the gel. However, during routine maintenance, the bridge assembly can be exposed to dust, moisture and dirt which can contaminate the gel. Due to the solid bottom of the jack, it is difficult, if not impossible, to clean or replace the gel. On the other hand, if an outdoor jack is designed without a solid bottom, high temperatures can loosen the gel and cause it to fall out the jack bottom. It would therefore be desirable to have such a bridge assembly for an outdoor environment that provides an easy way of replacing contaminated gel in the jack, while retaining the gel in normal usage.

Such customer bridge assemblies are typically installed in an opening provided therefore in a wall of a building entrance protector box. The assembly is retained in the opening by a resilient latch member and can be removed from the outside of the box by using a screwdriver or the like to release the latch member. It would therefore be desirable to provide some means of preventing removal of the customer bridge assembly by other than an authorized individual having access to the interior of the building entrance protector box.

SUMMARY OF THE INVENTION

According to the present invention, there is provided a customer bridge assembly for installation in a building entrance protector box. The inventive assembly comprises a housing for an RJ11 connector. The housing has a cavity open at opposite ends for receiving an RJ11 plug insertable in the cavity from one of the ends. A cover member is hingedly secured to the housing at the other end of the cavity. The cover member is pivotable to a predetermined orientation to close off the other end of the cavity.

In accordance with an aspect of this invention, the cover member is secured to the housing through a living hinge.

In accordance with another aspect of this invention, the assembly further comprises a resilient latch member adjacent the cavity for releasably retaining the assembly in an opening provided therefor in a wall of the box. The cover member is arranged to prevent movement of the latch member when the cover member is in the predetermined orientation.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
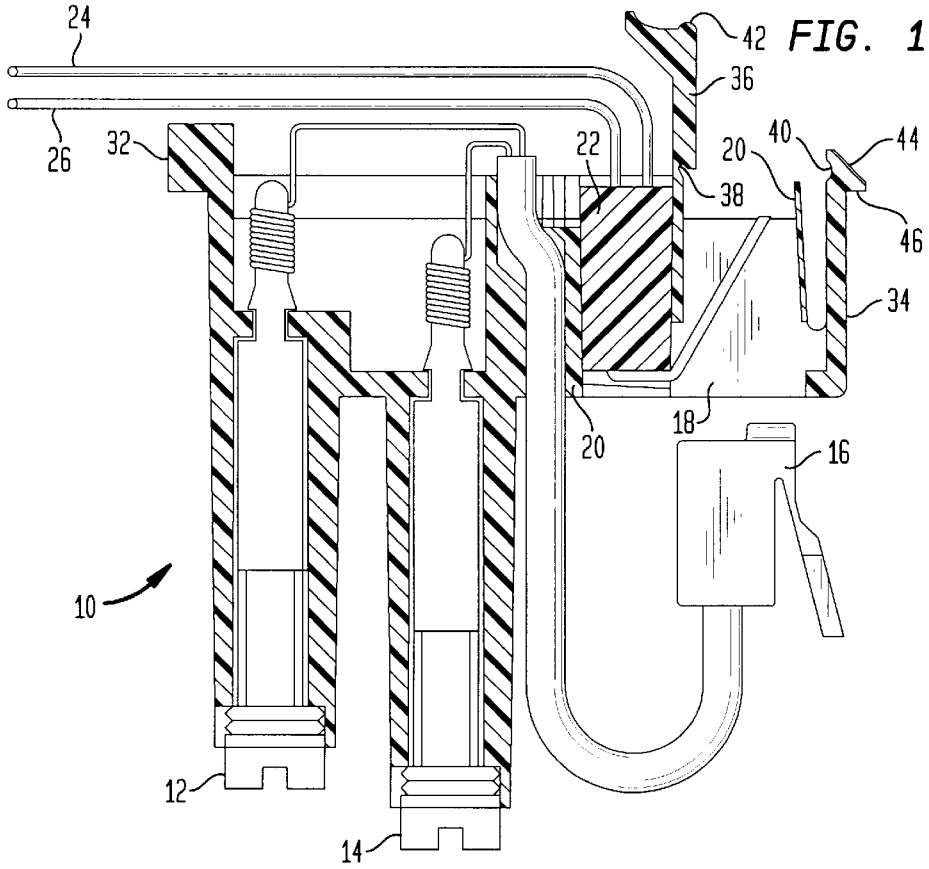
FIG. 1 is a cross sectional view showing a customer bridge assembly according to the present invention with the cover member in its open position and with the RJ11 plug disconnected from the jack.
Figure 2:
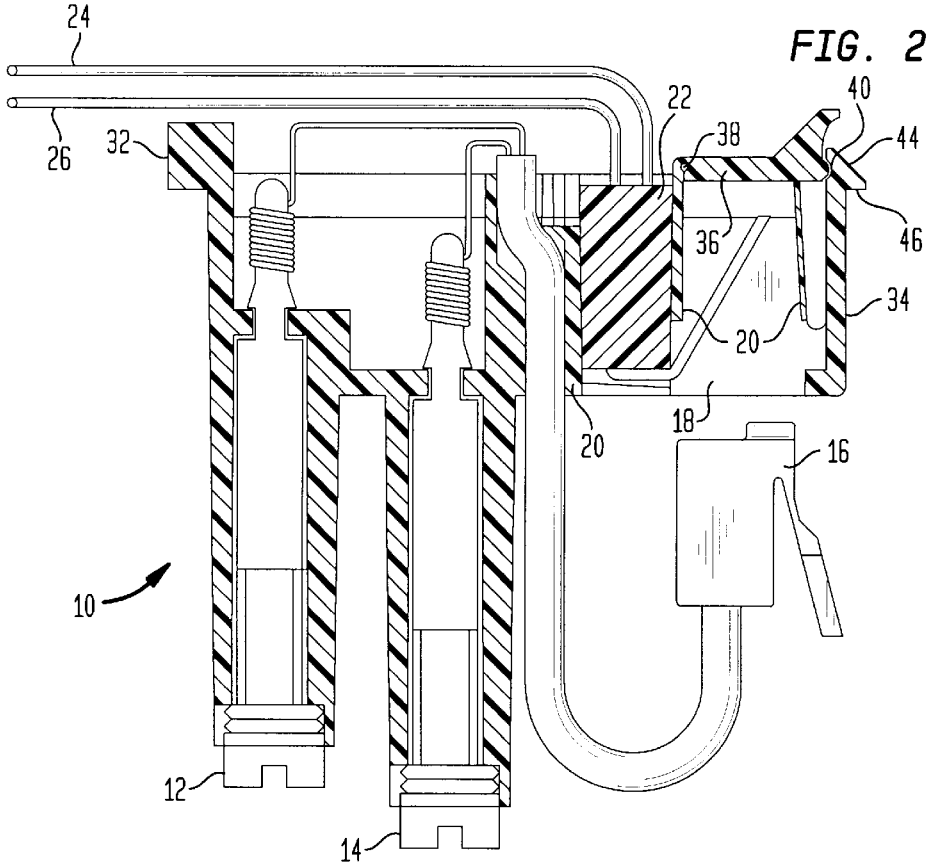
FIG. 2 is a view similar to FIG. 1 showing the cover member in its closed position.

Referring now to the drawings, the illustrated RJ11 customer bridge assembly, designated generally by the reference numeral 10, includes a pair of terminals 12, 14. Connections are made at exposed ends of the terminals 12, 14 to telephone wires (not shown) extending to a customer's premises. The terminals 12, 14 are connected at their other ends to wires of an RJ11 plug 16. The plug 16 is receivable within a cavity 18 in a housing 20 which holds an RJ11 jack 22. The cavity 18 is open at opposite ends, only the lower one of which (as viewed in the drawings) allows the plug 16 to be inserted therein. The jack 22 is connected to wires 24, 26 which extend to the telephone company outside plant. To install the assembly 10 in an opening 28 of a building entrance protector box wall 30 (FIG. 3), the assembly 10 is formed with a shoulder 32 at one end and a resilient latch member 34 at the end opposite the shoulder 32. The assembly 10 is installed in the opening 28 by first inserting the shoulder 32 inside the opening 28 and then pivoting the assembly 10 about the shoulder 32 until the latch member 34 snaps into place. The foregoing is conventional in the art and no further explanation is required.

According to the present invention, at the end of the cavity 18 opposite from the end in which the plug 16 is insertable (i.e., the upper end as viewed in the drawings), a cover member 36 is provided. The cover member 36 is hingedly secured to the housing 20, preferably by a living hinge 38 so that the housing 20 and the cover member 36 are of unitary construction. Thus, the cover member 36 is pivotable to a predetermined orientation (i.e., horizontal as viewed in the drawings) to close off the end of the cavity 18 opposite the insertion end for the plug 16.

Figure 3:
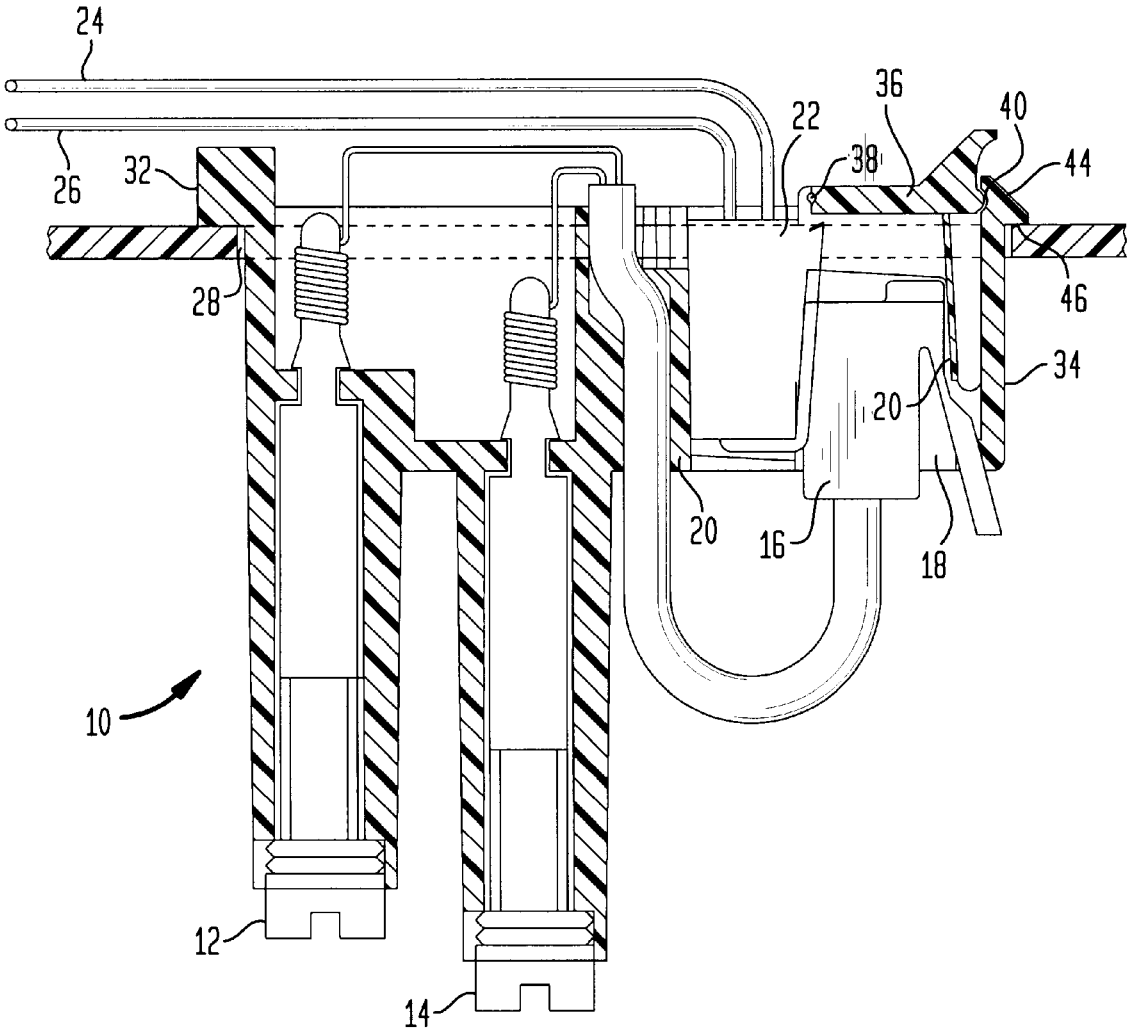
FIG. 3 is a cross sectional view showing the inventive customer bridge assembly installed in an opening in a wall of a building entrance protector box and with the cover member closed to retain the gel and to prevent movement of the latch member.

To keep the cover member 36 in its closed position, the latch member 34 is formed with an indentation 40 and the edge 42 of the cover member 36 opposite the hinge 38 is formed with a complementary protrusion which fits within the indentation 40 of the latch member 34. In addition to keeping the cover member 36 in its closed position, the complementary features of the indentation 40 and the edge 42 also provide a further advantageous function, as best seen in FIG. 3. As shown in FIG. 3, the region below the wall 30 is accessible to the public, whereas the region above the wall 30 is only accessible to authorized personnel having access to the interior of the building entrance protector box. As shown in FIG. 3, with the cover member 36 in its closed position, the latch member 34 cannot be moved to the left to release the assembly 10 from its retained position within the opening 28, thereby preventing removal of the assembly 10 by an unauthorized party.

To install the assembly 10, the cover member 36 is opened and the shoulder 32 is inserted through the opening 28 and hooked around the wall 30. The assembly 10 is then pivoted counterclockwise as viewed in the drawings and the camming surface 44 at the distal end of the latch member 34 causes the latch member 34 to move to the left and pass through the opening 28. The latch member 34 then snaps to the right after its shoulder 46 passes the wall 30 to retain the assembly 10 within the opening 28. The cover member 36 is then pivoted into its closed position. This is done from within the secure region of the building entrance protector box. Protective gel is then inserted in the cavity 18, followed by insertion of the plug 16. In the event the gel becomes contaminated, an authorized person with access to the interior of the building entrance protector box opens the cover member 36. This allows the latch member 34 to be moved to the left and the assembly 10 is removed from the opening 28. The plug 16 is removed from the cavity 18 and pressurized air is used to blow out the contaminated gel from the cavity 18. The aforedescribed installation steps are then performed.

Accordingly, there has been disclosed an improved RJ11 customer bridge assembly. While an illustrative embodiment of the present invention has been disclosed herein, it is understood that various adaptations and modifications to the disclosed embodiment are possible and it is intended that this invention be limited only by the scope of the appended claims.

What is claimed is:

1. A customer bridge assembly for installation in an opening of a building entrance protector box wall, comprising;

a housing for an RJ11 jack, the housing having a cavity open at opposite ends for receiving an RJ11 plug insertable in the cavity from one of said ends;

a cover member hingedly secured to said housing at the other end of the cavity, said cover member being pivotable to an engaged position to close off the other end of the cavity; and a resilient latch member formed on an opposite side of said cavity from said cover member for releasably retaining the assembly in said opening provided therefor in the wall of the box;

wherein said cover member is arranged to prevent release of said latch member from said opening when said cover member is in said engaged position.

2. The assembly according to claim 1 wherein said cover member is secured to said housing through a living hinge.

3. The assembly according to claim 1 wherein:

said latch member is formed with an indentation on a side facing said cavity;

said cover member is hingedly secured to said housing at a location remote from said latch member so that said cover member is pivotable toward and away from said latch member; and an edge of said cover member opposite where said cover member is hingedly secured is arranged to fit in said latch member indentation when said cover member is in said predetermined orientation to prevent movement of said latch member in a direction allowing release of said assembly from said opening.

4. The assembly according to claim 3 wherein said cover member is secured to said housing through a living hinge.

* * * * *